US009978212B2

(12) United States Patent
Vigunas et al.

(10) Patent No.: US 9,978,212 B2
(45) Date of Patent: May 22, 2018

(54) PEEL-AWAY SECURITY COVERING FOR A TICKET

(71) Applicants: Michael Vigunas, Lititz, PA (US); Robert Lundgren, Conestoga, PA (US); Neal McLoughlin, Chandlar, AZ (US); Phil Lulek, Scottsdale, AZ (US); William Krahl, Baldwinsville, NY (US)

(72) Inventors: Michael Vigunas, Lititz, PA (US); Robert Lundgren, Conestoga, PA (US); Neal McLoughlin, Chandlar, AZ (US); Phil Lulek, Scottsdale, AZ (US); William Krahl, Baldwinsville, NY (US)

(73) Assignee: MAX International Converters, Inc., Lancaster, PA (US)

( * ) Notice: Subject to any disclaimer, the term of this patent is extended or adjusted under 35 U.S.C. 154(b) by 0 days. days.

(21) Appl. No.: 13/647,771

(22) Filed: Oct. 9, 2012

(65) Prior Publication Data

US 2014/0097609 A1 Apr. 10, 2014
US 2017/0024966 A9 Jan. 26, 2017

Related U.S. Application Data

(62) Division of application No. 12/662,834, filed on May 5, 2010, now abandoned.

(51) Int. Cl.
*B42D 15/00* (2006.01)
*B42D 15/10* (2006.01)
(Continued)

(52) U.S. Cl.
CPC ..... *G07F 17/3251* (2013.01); *A63F 3/065* (2013.01); *A63F 3/0655* (2013.01);
(Continued)

(58) Field of Classification Search
CPC ..... G09B 19/00; B42D 15/00; B42D 15/10; B42D 15/025; A63B 71/00; A63F 1/00;
(Continued)

(56) References Cited

U.S. PATENT DOCUMENTS 4,726,608 A * 2/1988 Walton ..... 283/96
5,988,688 A * 11/1999 Such ..... 283/100
(Continued)

*Primary Examiner* — Justin V Lewis
(74) *Attorney, Agent, or Firm* — Merek, Blackmon & Voorhees, LL

(57) ABSTRACT

A solution for concealing confidential information that is printed at the point of sale in a game of chance utilizing a more common type printer designed for printing on a standard grade and biodegradable direct thermal paper. This system can print and cut each individual ticket in variable lengths. The unique and innovative concept of this new system allows a second and separate biodegradable substrate to be collated in a continuous stream over top of the printed ribbon before it is cut away and delivered into the presenter. The second substrate contains a strip of a specially formulated adhesive and is adhered to the top surface of the printed ribbon as the two substrates join together while passing through mechanical nip rollers. The confidential printed information is now covered and the combined substrates are cut and delivered as one ticket unit. The ticket information is revealed by easily peeling away the adhered top layer.

5 Claims, 3 Drawing Sheets

(51) Int. Cl.

| | |
|---|---|
| ***A63B 71/00*** | (2006.01) |
| ***A63F 1/18*** | (2006.01) |
| ***B32B 9/00*** | (2006.01) |
| ***B32B 33/00*** | (2006.01) |
| ***G07F 17/32*** | (2006.01) |
| ***B42D 15/02*** | (2006.01) |
| ***B41J 3/407*** | (2006.01) |
| ***A63F 3/06*** | (2006.01) |
| ***G07B 1/00*** | (2006.01) |

(52) U.S. Cl.
CPC ..... *B41J 3/4075* (2013.01); *B42D 15/025* (2013.01); *G07B 1/00* (2013.01)

(58) Field of Classification Search
CPC ..... A63F 1/18; A63F 3/0655; A63F 3/065; B41M 3/005; B41M 3/008; B41M 3/14; B32B 38/14; B32B 38/145; B41J 3/32; B41J 15/04; B41J 15/24; B41J 11/70; B41J 11/703; B41J 3/4075; B41J 15/18; G07B 1/00
USPC ..... 283/49, 56, 72, 81, 94, 98, 101, 903; 273/138.2, 138.1, 143 R, 139; 156/277, 156/384–388; 235/375–386; D19/69, 1, D19/22–28, 2, 5, 11, 32, 100; 428/40.1, 428/41.7, 41.8, 42.1, 42.3, 42.2
See application file for complete search history.

(56) References Cited

U.S. PATENT DOCUMENTS

| | | | | |
|---|---|---|---|---|
| 7,510,116 | B2 * | 3/2009 | Robb | G07C 15/005 235/380 |
| 2001/0045742 | A1 * | 11/2001 | Schulz | B42D 25/29 283/94 |
| 2002/0014526 | A1 * | 2/2002 | Imai | G07F 19/20 235/379 |
| 2009/0194988 | A1 * | 8/2009 | Wright et al. | 283/94 |
| 2010/0125499 | A1 * | 5/2010 | Cuch | B41M 3/14 705/14.45 |
| 2011/0214820 | A1 * | 9/2011 | Sato | B65C 9/0006 156/764 |
| 2012/0149561 | A1 * | 6/2012 | Ribi | B41M 3/005 503/200 |
| 2012/0175864 | A1 * | 7/2012 | Kennedy | 281/38 |
| 2012/0280483 | A1 * | 11/2012 | Jeske et al. | 283/74 |

* cited by examiner

PEEL-AWAY SECURITY COVERING FOR A TICKET

RELATED APPLICATIONS

This application is a divisional of U.S. patent application Ser. No. 12/662,834 having a filing date of May 5, 2010 and claims priority therefrom and also incorporates that application by reference herein in its entirety.

FIELD OF THE INVENTION

This invention relates to printed tickets for games of chance and the apparatus and methods for creating such printed tickets.

BACKGROUND OF THE INVENTION

Paper tickets for games of chance commonly include an opaque portion that can be removed either through the use of "scratch-off" materials or alternatively "pull-tabs". Both of these materials are used to hide from view until removed indicia such as numbers or symbols printed on the ticket. While scratch-off tickets use a coating that can be literally scraped off to reveal the indicia, pull-tabs have a laminate layer usually constructed of paper that can be at least partially removed to reveal the underlying indicia.

It has become common to use vending machines for selling games of chance. These machines usually have a choice of several games. In operation, a customer inserts money into the machine and presses a button to select a ticket for a particular game. The machine then produces the selected ticket from a slot. A significant drawback to this type of ticket vending is that the machines need to be preloaded with a variety of tickets for the various games being vended. This requires preprinting and shipping of the various tickets and frequent checking of the machines for refill. Furthermore, the rolls of preprinted tickets have redeemable value and there is always the possibility of loss or theft of the ticket rolls.

In an effort to avoid use of preprinted tickets, it has been proposed to use vending machines having the capability to print tickets on demand. However, such a method requires printing tickets through a substrate using prefabricated multi-layer thermal paper tickets and printing through the cover layer. The general solution has been to intensify the heat output produced by the direct thermal print head. This pre-lamination solution generally causes excessive wear on the thermal print head and paper cutter parts as well as resulting in slow print speed. These factors lead to increased unit maintenance costs. In addition, it has been found that the cost of pre-laminated paper is prohibitively expensive for use in a gaming environment.

In view of the foregoing it can be seen that there is a need for a new method and apparatus for producing a new ticket construction which avoids the necessity to preprint tickets and provides a ticket structure having an opaque security cover sheet.

OBJECTS AND SUMMARY OF THE INVENTION

One object of the invention is to provide a ticket having a first substrate that is a commonly used direct thermal recordable material that can be printed utilizing a standard direct thermal printing mechanism.

Another object of the invention is to provide a ticket printing system that offers the ability to print and deliver at variable lengths.

Yet another object of the invention is to provide a unique masking system for the printed image concealing the confidential information and is integrated and occurs immediately after the image is printed.

Still another object of the invention is to provide a second substrate that contains a strip of specially formulated adhesive and will not become permanently attached to the first substrate.

Yet another object of the invention is to provide a specially formulated adhesive that can be adhered to the printed image material and will not cause the image to fade or degrade.

Still another object of the invention is to provide a specially formulated adhesive that is applied to the bottom side of the second substrate during a unique manufacturing/coating process that allows for a specific amount of wet coating to be applied and cured.

Yet another object of the invention is to provide a specially formulated primer agent that is applied to the bottom side of the second substrate during the manufacturing/coating process that allows for the adhesive coating to remain intact to the substrate.

Still another object of the invention is to provide a specially formulated release coating that is applied to the top side of the second substrate during the manufacturing/coating process that allows for easy unwinding of the self-wound roll of the adhesive coated roll product.

Another object of the invention is to provide an electronic control board to control paper feed motors, paper cutting system, voltage regulation, thermal head, and communication interface.

Still another object of the invention is to provide a direct thermal print head for producing the actual text and images that get printed on the thermal paper.

Yet another object of the invention is to provide a custom chassis to support the physical mounting of a pair of paper rolls.

Still another object of the invention is to provide a heavy duty cutter for separating tickets from the supply rolls.

Another object of the invention is to provide a funnel paper feed system for creating a multi-layer ticket.

Yet another object of the invention is to provide a paper bonding system to complete the lamination process.

In summary, this invention is directed to a solution for concealing confidential information that is printed at the point of sale in a game of chance utilizing a more common type printer designed for printing on a standard grade and biodegradable direct thermal paper. This system can print and cut each individual ticket in variable lengths. The unique and innovative concept of this new system allows a second and separate biodegradable substrate to be collated in a continuous stream over top of the printed ribbon before it is cut away and delivered into the presenter. The second substrate contains a strip of a specially formulated adhesive and is adhered to the top surface of the printed ribbon as the two substrates join together while passing through mechanical nip rollers. The confidential printed information is now covered and the combined substrates are cut and delivered as one ticket unit. The ticket information is revealed by easily peeling away the adhered top layer. This invention addresses paper cost issues by using standard thermal paper stock and standard bond paper with print safe adhesive. Thermal print head maintenance risks have been mitigated by using the print head heat output at normal levels. Paper cutter maintenance (and replacement) issues have been solved by using the heavy duty paper cutter. Also, the paper is loaded into the printer via a funnel paper feed system.

Furthermore, the invention is directed to a ticket structure for a game of chance, comprising a first opaque substrate formed of thermal paper having indicia thereon for use in playing a game of chance and a second opaque substrate overlying said first substrate and having an adhesive layer for connecting said first substrate to said second substrate and forming an opaque covering over said indicia. The adhesive layer has a greater adherence to said second substrate than said first substrate and is releasably adhered to said first substrate such that said second substrate may be removed from said first substrate without altering said indicia.

Additionally the invention is directed to a machine for manufacturing tickets for a game of chance, comprising a chassis for supporting equipment for use in the manufacture of tickets for a game of chance and a first paper roll bracket mounted to said chassis for holding a roll of thermal paper and a second paper roll bracket mounted to said chassis for holding a roll of adhesive coated paper and a thermal print head cooperatively located adjacent said first roll of thermal paper for printing indicia on said thermal and a system of rollers for aligning said adhesive coated paper with said thermal paper and applying pressure to form a ticket and a cutting mechanism for cutting through said thermal paper and said adhesive coated paper simultaneously.

Additionally, the invention is directed to a method of vending tickets from a point of sale vending machine, comprising the steps of providing a vending machine having a plurality of ticket choices providing a mechanism on said vending machine for selecting a ticket from said plurality of ticket choices and producing a ticket from a roll of paper within said vending machine and printing indicia on said ticket, said indicia corresponding to a game of chance and adhering a releasable layer over said ticket after printing indicia on said ticket and separating said ticket from said roll of paper and dispensing said ticket from said vending machine.

DETAILED DESCRIPTION OF THE PREFERRED EMBODIMENT

Figure 1:
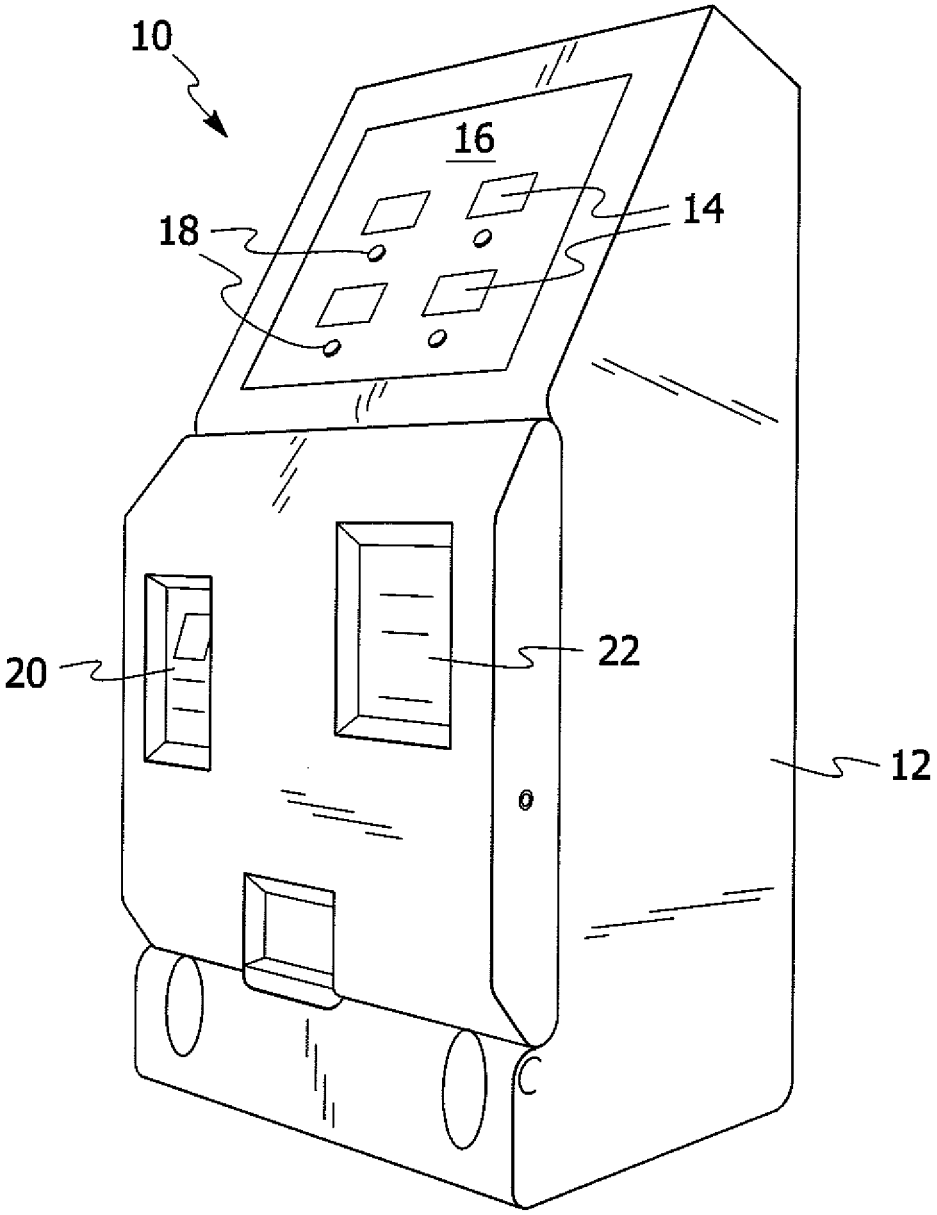
FIG. 1 depicts a vending machine.

FIG. 1 illustrates a typical ticket vending machine 10 having an outer box 12 for containing and securing ticket vending equipment as will be described below. The vending machine 10 includes a plurality of choices 14 of games of chance displayed on the front wall 16. Each of the choices 14 generally includes a button 18 for making a selection. To make a selection, a customer inserts the required fee into the machine at slot 20. The customer then makes a selection and the vending machine 10 produces a ticket T from the opening 22.

Figure 2:
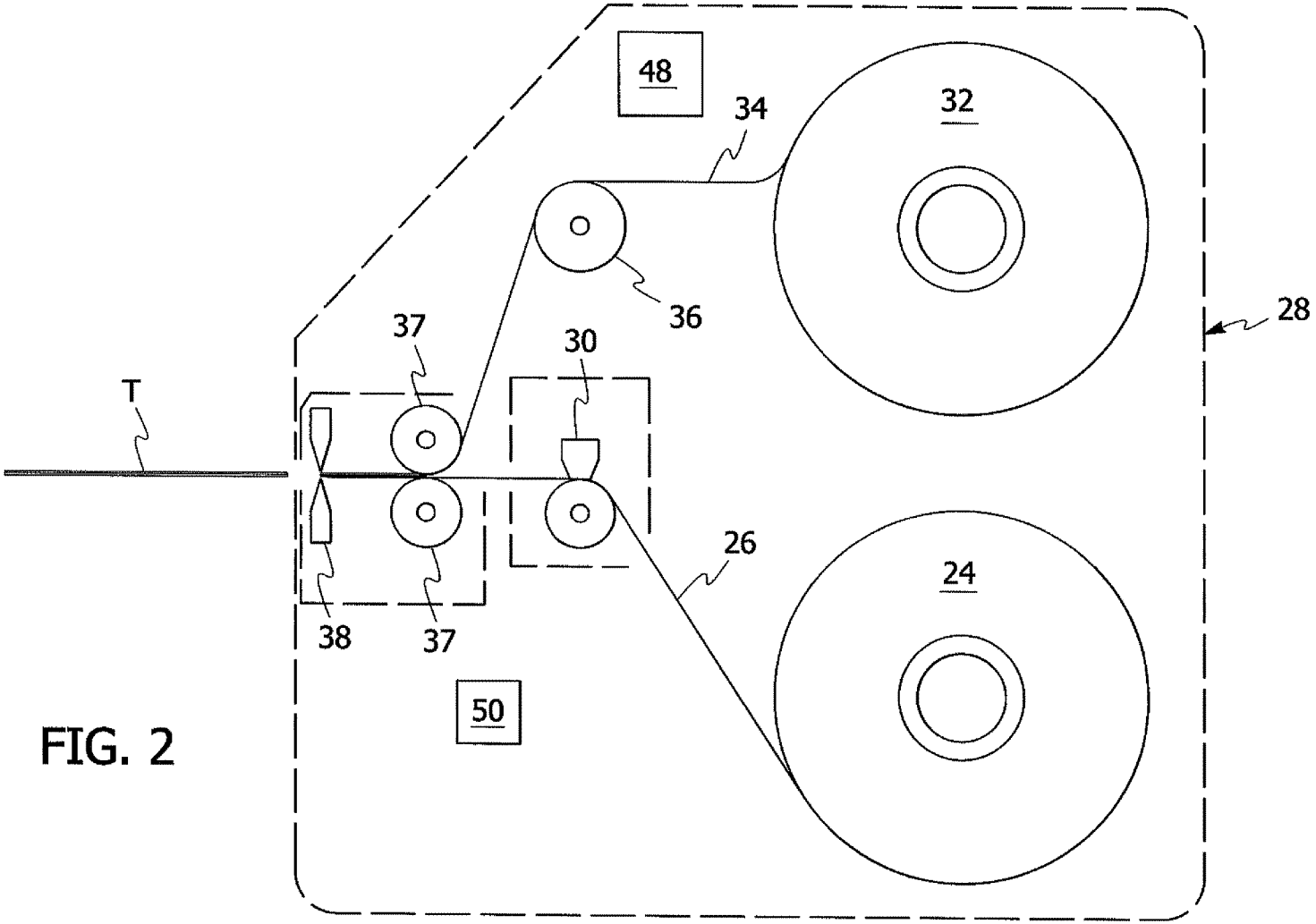
FIG. 2 depicts a schematic view of the ticket manufacturing components.
Figure 3:
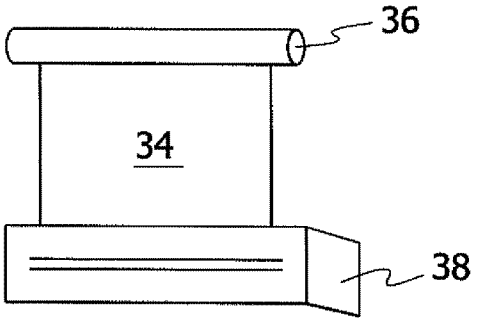
FIG. 3 is a schematic view of a roller assembly and cutter portion.

Now the construction of the ticket T will be described with reference to FIGS. 2 and 3. In FIG. 2, a roll 24 of thermal paper substrate 26 is supported on a chassis 28 within the vending machine 10. As the thermal paper substrate 26 is dispensed from the roll 24, the paper substrate 26 enters the print head 30 and indicia P in the form of numbers or symbols is printed thereon. While the arrangement of the roll 24 and print head 30 have been shown schematically, it should be understood that the invention is not limited to the specific arrangement shown but could also include conventional paper roll and thermal print head arrangements as long as the printed paper exits the print head in the proper location for the next step in the ticket making process. A roll 32 of adhesive coated paper substrate 34 is supported on the chassis 28 adjacent the roll 24. Alignment guides 36 feed the paper substrate 34 from the roll 32 and align paper substrate 34 over paper substrate 26 after the paper substrate 26 has left the print head 30. The adhesive coated paper substrate 34 and printed thermal paper substrate 26 pass through a pair of nip rollers 37 or alternatively a clutch assembly to adhere the substrates 26 and 34 together and then to a paper cutter 38. After the printed portion of thermal paper 26 has passed through cutter 38, the cutter 38 is activated and separates the ticket T from the rolls 32 and 24 and produces the ticket T to the customer at the opening 22. An electronic control board 48 regulates the paper feed motors 50, the paper cutter 38, voltage regulation, the thermal print head 30 and the communication interfaces and selection buttons 18. Thus when a customer makes a selection of a game and inserts the proper fee and then presses a button 18, the control board 48 activates the vending machine 10 to produce a ticket T.

Figure 4:
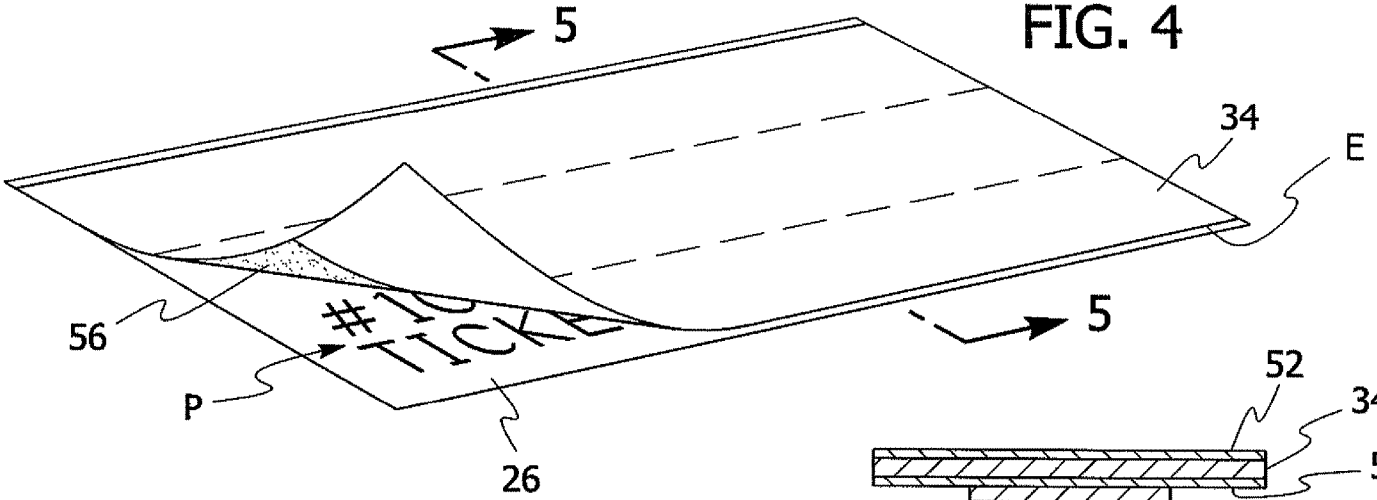
FIG. 4 is a top plan view of a ticket.
Figure 5:
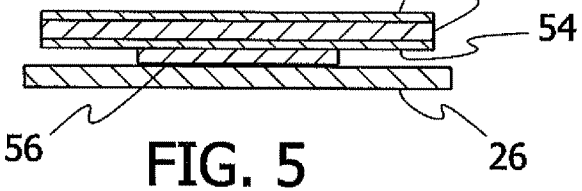
FIG. 5 is a cross-sectional view of the ticket of FIG. 4 taken along lines 5-5.

Now the structure of the ticket T will be described with respect to FIGS. 4 and 5. FIG. 4 is a top plan view of the ticket T wherein the adhesive coated paper substrate 34 is located on top of printed paper substrate 26. Preferably, substrate 26 is slightly wider than substrate 34 which allows for easier separation of the substrates to reveal the printed indicia P by creating a lift edge E. FIG. 5 is a cross-sectional view of the ticket T of FIG. 4 taken along lines 5-5. Substrate 26 forms a base layer for the ticket T. The adhesive coated substrate 34 preferably includes a release coating 52 on the top surface and a primer coating 54 on the bottom surface. An adhesive strip 56 is located on the primer coating 54. The release coating 52 prevents sticking of the adhesive strip 56 to the top surface of the substrate 34 when it is on the roll 32. The primer coating 54 provides a material that provides increased adherence of the adhesive strip 56 so that the adhesive strip 56 will stay on substrate 34 and not transfer to substrate 26 when the substrate 34 is removed to reveal the indicia P. The adhesive strip 56 is a releasable adhesive material which does not easily degrade and is readily releasable from paper substrate 26 without removing any of the indicia P. The range of coat weight of the adhesive applied wet would be in the range of 3 to 5 grams/meter$^2$ and in the range of 0.5 to 1.5 grams/meter$^2$ dry. While the adhesive strip has been shown as located centrally of the longitudinal axis of the ticket T, it should be understood that the adhesive strip 56 could be placed more to one side or the other or could extend across the entire width of the substrate 34. The formulations and methods of making the release coating 52, the adhesive strip 56 and primer coating 54 can be found in U.S. patent application Ser. No. 11/798,975 filed on May 18, 2007 having Patent Application Publication No. 20070267146 which is incorporated by reference herein in its entirety.

In conclusion, the present invention is directed to a solution for concealing confidential information that is printed at the point of sale utilizing a more common type printer designed for printing on a standard grade and biodegradable direct thermal paper. This system as described above can print and cut each individual ticket T in variable lengths. This new system allows a second and separate biodegradable substrate 34 to be collated in a continuous stream over top of the printed ribbon of substrate 26 before it is cut away and delivered to the end user. The second substrate 34 contains a strip of a specially formulated adhesive and is adhered to the top side of the printed ribbon of substrate 26 as the two substrates 26 and 34 join together while passing through mechanical nip rollers or clutch assembly 37. The confidential printed information P is now covered and the combined substrates are cut and delivered as one ticket unit T. The ticket information P is revealed by easily peeling away the adhered top substrate or layer 34.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims.

We claim:

1. A machine for manufacturing tickets for a game of chance, comprising:

a) a chassis for supporting equipment for use in manufacturing a plurality of tickets for a game of chance;

b) a first paper roll bracket mounted to said chassis for holding a roll of thermal paper;

c) a second paper roll bracket mounted to said chassis for holding a roll of adhesive coated paper;

d) a thermal print head supported by said chassis and located adjacent said first roll of thermal paper for printing indicia on said thermal paper before said adhesive coated paper is adhered to said thermal paper to cover said indicia;

a system of rollers for aligning said adhesive coated paper with said thermal paper as said adhesive coated paper and said thermal paper are unrolled from their respective rolls and applying pressure to said adhesive coated paper and said thermal paper to adhere at least a portion of said adhesive coated paper to said thermal paper;

f) a cutting mechanism for cutting through said thermal paper and said adhesive coated paper simultaneously to form a separate ticket; and, g) said adhesive coated paper includes a coating of releasable adhesive on a first side and release coating on a back side of said adhesive paper for enhancing unrolling of said adhesive coated paper.

2. The machine as set forth in claim 1, further including:

a) an electronic control board for receiving customer input and controlling said equipment to produce said separate ticket in response to customer input.

3. The machine as set forth in claim 2, wherein:

a) said customer input includes choosing a game of chance by pressing a button on said electronic control board.

4. The machine as set forth in claim 3, wherein:

a) said separate ticket has a length that can be set by customer input.

5. The machine as set forth in claim 1, wherein:

a) said adhesive coated paper includes a primer layer, a paper layer and an adhesive layer wherein said primer layer is located between said paper layer and said adhesive layer which enhances retention of said adhesive layer to said paper layer.

* * * * *